US007134663B1

(12) United States Patent
Lowe et al.

(10) Patent No.: US 7,134,663 B1
(45) Date of Patent: Nov. 14, 2006

(54) THREE-DIMENSIONAL ARCHERY TARGET WITH MULTIPLE VITAL TARGET AREAS

(76) Inventors: Gregory D. Lowe, 1860 47th Ave. NE., Naples, FL (US) 34120; Edwin J. Beckman, 4295 18th St. NE., Naples, FL (US) 34120

( * ) Notice: Subject to any disclaimer, the term of this patent is extended or adjusted under 35 U.S.C. 154(b) by 0 days.

(21) Appl. No.: 11/129,947

(22) Filed: May 16, 2005

(51) Int. Cl.
*F41J 3/00* (2006.01)

(52) U.S. Cl. ..... 273/403

(58) Field of Classification Search ..... 273/403–409, 273/359, 366–370; 446/320
See application file for complete search history.

(56) References Cited

U.S. PATENT DOCUMENTS

| | | | | |
|---|---|---|---|---|
| 2,726,870 | A * | 12/1955 | Auger | 273/370 |
| 4,203,600 | A | 5/1980 | Brown | |
| 4,477,082 | A | 10/1984 | McKenzie et al. | |
| 5,308,084 | A | 5/1994 | Morrell | |
| 5,498,001 | A | 3/1996 | Franks et al. | |
| 5,503,403 | A | 4/1996 | Morrell | |
| 6,174,216 | B1 * | 1/2001 | Chianese | 446/320 |
| 6,254,100 | B1 | 7/2001 | Rinehart | |
| 6,550,773 | B1 | 4/2003 | McKenzie et al. | |
| 6,575,469 | B1 | 6/2003 | Love | |
| 2004/0108659 | A1 | 6/2004 | Pulkrabek | |

OTHER PUBLICATIONS

Cabela's Archery 2005 Catalog.
RedHead Fall Hunting Catalog 2004 Bass Pro Shops.

* cited by examiner

*Primary Examiner*—Mark S. Graham
(74) *Attorney, Agent, or Firm*—The Livingston Firm; Edward M. Livingston; Angela M. Miller

(57) ABSTRACT

A three-dimensional archery target device (1) comprised of an animal-like target having a body section (2) and preferably two head sections (3). The body section (2) has at least two vital target areas (5) on each side of the body section (2) representing the chest area of an animal. To use the present invention, a person positions the target device (1) in a predetermined location as desired. Because the target has at least two vital areas (5) on each body section (2) side, a hunter/archer is able to have multiple angels of insertion (10A, 10B) into a vital area (5). In addition, because the target includes two head sections (3), a hunter/archer is better able to pinpoint a vital target area (5). The target device (1) may have the shape of a deer, bear, elk, moose, duck, goose, rabbit, antelope and the like.

2 Claims, 2 Drawing Sheets

THREE-DIMENSIONAL ARCHERY TARGET WITH MULTIPLE VITAL TARGET AREAS

BACKGROUND OF THE INVENTION

This invention relates to archery target devices, more particularly, a three-dimensional archery target device that has at least two vital target areas.

Rather than using one-dimensional planar archery targets, hunters/archers prefer to use three-dimensional targets in order to have more realistic target practices. The current three-dimensional archery targets, which may be shaped and sized like live deer or other animals, contain only one vital target area wherein hunters/archers aim. The hunter/archer focuses on the front end of the animal, typically the head and chest area, and visually maps out the vital target area in relation to the head. In all cases, the vital target area is chest area of an animal target wherein the heart and lungs are located. Hunters/archers simply place the target at a desired location, move away from the target and aim for the chest area.

Although the use of conventional three-dimensional archery targets provide the most realistic hunting/archery target scenario, there are several drawbacks to using such targets. First, because the chest area is the most desired area to hit a deer, skilled archers find themselves hitting the same area again and again, thereby breaking up and destroying the chest. Second, if the chest area is broken up so much so as to no longer be useful, a hunter/archer must purchase an entirely new target or, at the very least, a new target area, which is costly. Third, as these highly skilled archers aim for and hit the same area, he or she must shoot and remove one arrow at a time in order to avoid damaging the arrow already in the chest as replacing damaged arrows is costly. Fourth, as the hunter/archer focuses primarily on the front section of an animal-shaped target, the hind-quarters are unneeded and therefore frivolous. Finally, as the targets only have one vital target area on each side of the target, archers must either reposition the target, reposition his or her placement in relation to the target or use a plurality of targets in order to have diversified angle of insertion target practice.

Thus, a need exists for a three-dimensional archery target device having at least two vital target areas on at least one side.

The relevant prior art includes the following references:

| Patent No. (U.S. unless stated otherwise) | Inventor | Issue/Publication Date |
|---|---|---|
| 6,550,773 | McKenzie et al. | Apr. 22, 2003 |
| 6,254,100 | Rinehart | Jul. 3, 2001 |
| 4,477,082 | McKenzie et al. | Oct. 16, 1984 |
| 2004/0108659 | Pulkrabek | Jun. 10, 2004 |
| 6,575,469 | Love | Jun. 10, 2003 |
| 5,308,084 | Morrell | May 3, 1994 |
| 5,503,403 | Morrell | Apr. 2, 1996 |
| 4,203,600 | Brown | May 20, 1980 |
| 5,498,001 | Franks et al. | Mar. 12, 1996 |

SUMMARY OF THE INVENTION

The primary object of the present invention is to provide a three-dimensional archery target device that has more than one vital target area.

A further object of the present invention is to provide a three-dimensional archery target device that allows for multiple angles of insertion into vital target areas.

An even further object of the present invention is to provide a three-dimensional archery target device that is easy to use.

A further object of the present invention is to provide a three-dimensional archery target device that has an animal-like appearance.

The present invention fulfills the above and other objects by providing a three-dimensional archery target device comprised of an animal-like target having two half body sections. Each half body section preferably has a head section in order to give a more realistic appearance. The body section has at least two vital target areas on each side of the body section representing the chest area of an animal.

To use the present invention, a person positions the target in a predetermined location as desired. As the target has two vital areas on each body section side, a hunter/archer is able to have at least two target angles from which to shoot at a vital area of the target, one angle simulating an approaching animal and the other a departing animal. In addition, because the target includes two head sections, a hunter/archer is better able to pinpoint a vital target area.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
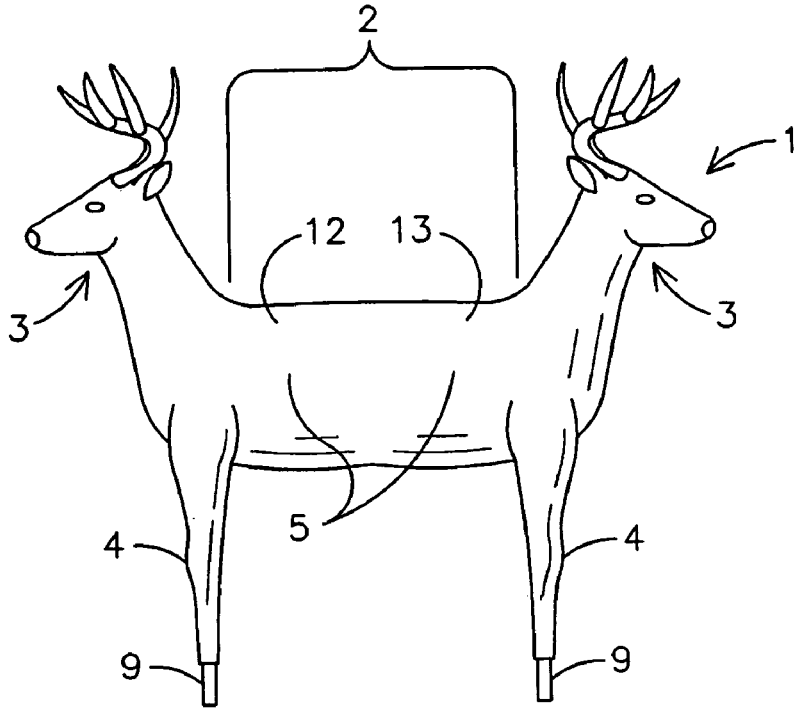
FIG. 1 is a side view of a first embodiment of the present invention.

For purposes of describing the preferred embodiment, the terminology used in reference to the numbered components in the drawings is as follows:

| | |
|---|---|
| 1. | three-dimensional archery target device, generally |
| 2. | body section |
| 3. | head section |
| 4. | leg |
| 5. | vital target area |
| 6. | dovetail joint |
| 7. | male connector |
| 8. | female connector |
| 9. | stake |
| 10A. | first target angle |
| 10B. | second target angle |
| 11. | bow and arrow |
| 12. | first section |

-continued

| | |
|---|---|
| 13. | second section |
| 14. | first side |
| 15. | second side |

With reference to FIG. 1, a side view of a first embodiment of the present invention is shown having a deer shape. The three-dimensional archery target device 1 comprises a body section 2 having a first section 12 and a second section 13. Each section 12 and 13 is in the shape of an animal half body. At least two vital target areas 5 are located on the body section 2. In order to give a more realistic archery/hunting scenario that will enable an archer/hunter to focus primarily on the front portion of the animal, which is the most important area of the animal when hunting, the three-dimensional archery target device 1 preferably includes at least two head sections 3 and legs 4. The legs 4 have a means of retaining the target device 1 in an upright position in the ground. The preferred means of retaining in FIG. 1 are shown to stakes 9.

Figure 2:
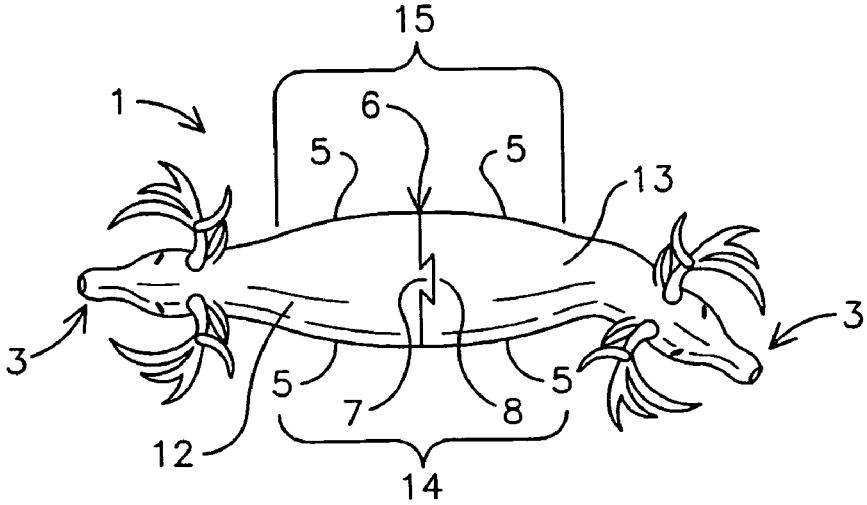
FIG. 2 is a top view of a second embodiment of the present invention.

In FIG. 2, a top view of a second embodiment of the present invention is shown. Rather than being assembled in one piece, the present invention may comprise a first section 12 and a second section 13 which are fastened together to create the three-dimensional archery target device 1. The means of fastening together the first and second sections 12 and 13 is preferably by utilizing a dovetail joint 6, although other fastening means, such as a universal fastener, may also be used. The first section 12 may have a male connector 7 while the second section 13 may have a correspondingly fitting female connector 8. Although a dovetail joint 6 is shown, other means of fastening may be used. Also, the head sections 3 of the target device 1 may have moveable or non-movable head tilting angles so as to give a hunter/archer a variety of practice scenarios. In addition, the head sections 3 may be lowered or raised. Varying mechanisms may be used to permit a moveable head, such as an internal hinge, separate hooks and the like. Preferably, a vital target area 5 is located on a first side 14 and second side 15 of each section 12 and 13 so as to have a total of four vital target areas 5 per target device 1.

Figure 3:
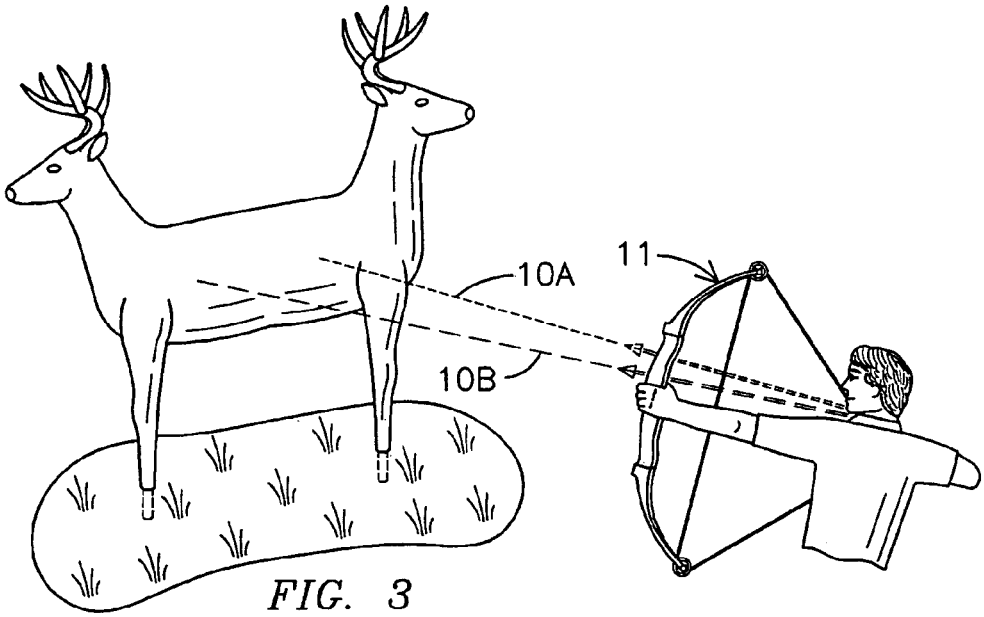
FIG. 3 is a perspective view of the first embodiment showing varying target angles.

With reference to FIG. 3, a perspective view of the first embodiment showing varying target angles 10A and 10B are shown. Because the target device 1 comprises at least two vital target areas 5 on one side of the target device 1, a hunter/archer will be able to stay in one location while having multiple target angles 10A and 10B from the bow and arrow 11 into a vital target area 5. In addition, multiple hunters/archers may practice on the same target device 1 at the same time.

Figure 4:
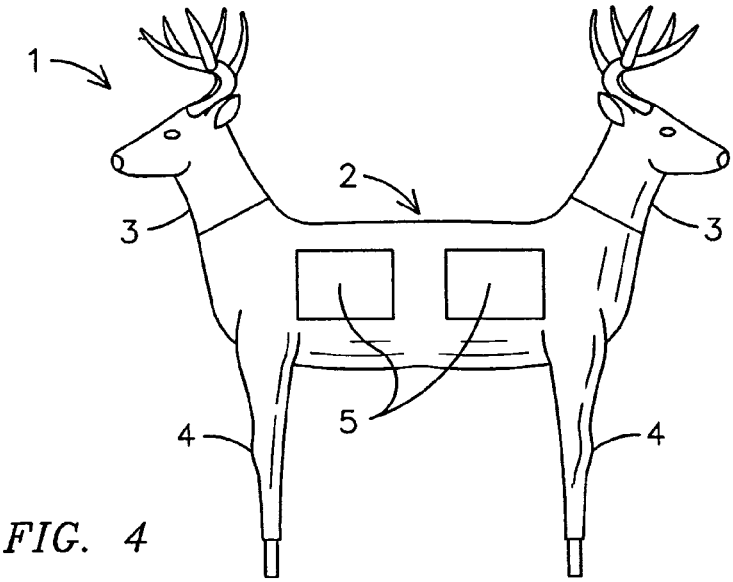
FIG. 4 is a side view of a third embodiment of the present invention.

In FIG. 4, a side view of a third embodiment of the present invention is shown. The third embodiment may include removable vital target areas 5 from the three-dimensional archery target device 1. If using this embodiment, a person may simply remove and replace the used vital target area 5 when it is no longer useful. In addition, the head sections 3 may be removable and replaceable as well.

Figure 5:
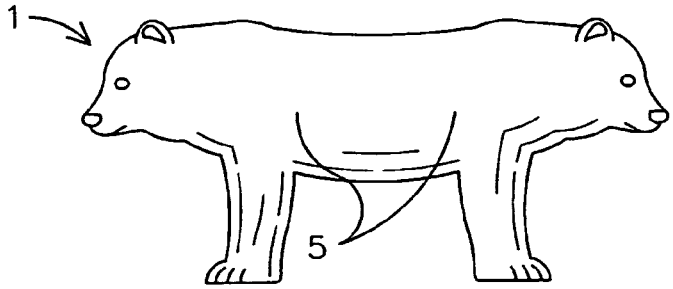
FIG. 5 is a side view of a first embodiment of the present invention having a bear shape.

Finally, FIG. 5 shows a side view of a first embodiment of the present invention having a bear shape. Similar to the deer shapes shown in FIGS. 1–4, the bear shape has at least two vital target areas 5.

In addition, the present invention may be manufactured in a variety of animal shapes and sizes so as to accommodate a hunter/archer's personal shooting preference, such as duck, geese, elk, rabbit, antelope, moose and the like.

The use of the present invention will allow a person to have a longer-lasting, more realistic archery/hunting practice with varying target angles.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

We claim:

1. A three-dimensional archery target device comprising:

a body section having a first and a second section;

said first section simulating a half body shape of a deer;

said first section having at least one vital target area;

a head section simulating a head of a deer attached to said first section;

said second section simulating a half body shape of a deer;

said second section having at least one vital target area;

a head section simulating a head of a deer attached to said second section;

two legs attached to said first section having stakes at a bottom end for securing the device to a ground surface; and two legs attached to said second section having stakes at a bottom end for securing the device to a ground surface.

2. A three-dimensional archery target device comprising:

a body section having a first and a second section;

said first section simulating a half body shape of a deer;

said first section having a first side and a second side;

said first section having at least one vital target area on said first side;

said first section having at least one vital target area on said second side;

a head section simulating a head of a deer attached to said first section;

said second section simulating a half body shape of a deer;

said second section having a first side and a second side;

said second section having at least one vital target area on said first side;

said second section having at least one vital target area on said second side;

a head section simulating a head of a deer attached to said second section;

two legs attached to said first section having stakes at a bottom end for securing the device to a ground surface; and two legs attached to said second section having stakes at a bottom end for securing the device to a ground surface.

* * * * *